US009371753B2

(12) United States Patent
Park

(10) Patent No.: US 9,371,753 B2
(45) Date of Patent: Jun. 21, 2016

(54) SYSTEM OF CONTROLLING EXHAUST SOUND OF VEHICLE AUTOMATICALLY AND METHOD OF THE SAME

(71) Applicant: Hyundai Motor Company, Seoul (KR)

(72) Inventor: Ki Chul Park, Suwon-si (KR)

(73) Assignee: Hyundai Motor Company, Seoul (KR)

( * ) Notice: Subject to any disclaimer, the term of this patent is extended or adjusted under 35 U.S.C. 154(b) by 194 days.

(21) Appl. No.: 14/143,745

(22) Filed: Dec. 30, 2013

(65) Prior Publication Data

US 2015/0053500 A1 Feb. 26, 2015

(30) Foreign Application Priority Data

Aug. 26, 2013 (KR) ..... 10-2013-0101207

(51) Int. Cl.

| | |
|---|---|
| ***F01N 1/16*** | (2006.01) |
| ***H04R 29/00*** | (2006.01) |
| ***H04B 1/00*** | (2006.01) |
| ***H04R 25/00*** | (2006.01) |
| ***G08B 3/10*** | (2006.01) |

(52) U.S. Cl.

CPC ..... *F01N 1/163* (2013.01); *F01N 1/166* (2013.01)

(58) Field of Classification Search

CPC ..... H04S 7/00; G10H 1/16; H03F 1/327; H04N 11/00; G01H 3/14; F01N 1/16; G08B 3/10; H04R 29/00; H04R 25/00

USPC ..... 381/56, 61, 161, 86; 340/425.5; 701/36; 181/241

See application file for complete search history.

(56) References Cited

U.S. PATENT DOCUMENTS

2007/0182525 A1* 8/2007 McCarthy ..... H04S 7/00 340/425.5
2014/0121896 A1* 5/2014 Valeri ..... B60Q 9/00 701/36

FOREIGN PATENT DOCUMENTS

JP 2004-316619 A 11/2004
KR 2000-0009331 U 6/2000
KR 10-2011-0038260 A 4/2011

* cited by examiner

*Primary Examiner* — Thjuan K Addy
(74) *Attorney, Agent, or Firm* — Morgan, Lewis & Bockius LLP

(57) ABSTRACT

A system and method automatically controls exhaust sound of a vehicle according to music chosen by a driver for the pleasure of driving. The system may include a media reproducing device which plays music and outputs a music playback signal, a control unit which analyzes a frequency of the music playback signal output from the media reproducing device and generates a drive signal according to the frequency, and a variable valve of a muffler installed in the muffler which adjusts the exhaust sound according to the drive signal output from the control unit.

5 Claims, 5 Drawing Sheets

FREQUENCY WAVEFORM OF SPORT MODE

FREQUENCY WAVEFORM OF SILENT MODE

FREQUENCY WAVEFORM OF SPORT MODE MUSIC (DANCE)

(a)

FREQUENCY WAVEFORM OF SILENT MODE MUSIC (b)

SYSTEM OF CONTROLLING EXHAUST SOUND OF VEHICLE AUTOMATICALLY AND METHOD OF THE SAME

CROSS-REFERENCE TO RELATED APPLICATION

The present application claims priority of Korean Patent Application Number 10-2013-0101207 filed Aug. 26, 2013, the entire contents of which application is incorporated herein for all purposes by this reference.

BACKGROUND OF INVENTION

1. Field of Invention

The present invention relates to a system of controlling exhaust sound of a vehicle automatically and a method of the same. More particularly, the present invention relates to the system of controlling exhaust sound of a vehicle automatically and a method of the same that control vehicle exhaust sound according to music chosen by a driver for the pleasure of driving.

2. Description of Related Art

Recent vehicles have been silent such that the driver does not notice the exhaust sound or hardly hears the exhaust sound because of technology development.

However, while some drivers prefer a silent vehicle, other drivers prefer a loud exhaust sound for tension of driving or a rough engine check.

A traditional apparatus for controlling vehicle exhaust sound includes a variable valve installed inside an exhaust muffler that controls the exhaust sound by opening or closing the variable valve depending on a driver's choice.

However, some drivers who do not have an interest or do not know much about exhaust sound can't enjoy the pleasure of driving.

The information disclosed in this Background section is only for enhancement of understanding of the general background of the invention and should not be taken as an acknowledgement or any form of suggestion that this information forms the prior art already known to a person skilled in the art.

BRIEF SUMMARY

Various aspects of the present invention provide for a system of controlling exhaust sound of a vehicle automatically and a method of the same having advantages of enjoying driving by controlling exhaust sound according to music chosen by a driver rather than selecting a button for exhaust sound among many other buttons.

Various aspects of the present invention provide for a system of controlling exhaust sound of a vehicle automatically may include a media reproducing device which plays music and outputs a music playback signal, a control unit which analyzes a frequency of the music playback signal output from the media reproducing device and generates a drive signal according to the frequency, and a variable valve of a muffler installed in the muffler which adjusts the exhaust sound according to the drive signal output from the control unit.

The control unit may include an input section which receives the music playback signal, an analysis section which analyzes the frequency of the music playback signal, a determination section which determines a mode of the music played currently according to the analyzed frequency of the music playback signal, and an output section which generates and outputs a drive signal according to the determined mode of the music.

The analysis section may produce a frequency histogram by transforming the frequency of the music playback signal and classify the frequency of the music playback signal into a low frequency band, a medium frequency band, and a high frequency band. The determination section may determine a silent mode when a level of the medium frequency band is higher than a level of the low frequency band and a level of the high frequency band, and determine a sport mode when the level of the medium frequency band is lower than or equal to the level of the low frequency band or the level of the high frequency band.

The variable valve of the muffler may be open during the sport mode so that at least some of exhaust gas does not pass through the muffler, and the variable valve of the muffler may be closed during the silent mode so that all of the exhaust gas passes through the muffler.

Various aspects of the present invention provide for a method of controlling exhaust sound of a vehicle automatically by a variable valve of a muffler installed in the muffler that may include determining whether music is selected, outputting a music playback signal if the music is selected, analyzing a frequency of the music playback signal, determining a mode of the music according to the analyzed frequency, and driving the variable valve of the muffler according to the determined mode.

The analyzing the frequency of the music playback signal may include receiving the music playback signal, producing a frequency histogram by transforming the music playback signal, and classifying the music playback signal analyzed by frequency into a low frequency band, a medium frequency band, and a high frequency band.

The determining of the mode of the music according to the analyzed frequency may include determining whether a level of the medium frequency band is higher than a level of the low frequency band and a level of the high frequency band, and determining a silent mode when the level of the medium frequency band is higher than the level of the low frequency band and the level of the high frequency band. In addition, the determining of the mode of the music according to the analyzed frequency may further include determining a sport mode when the level of the medium frequency band is lower than or equal to the level of the low frequency band or the level of the high frequency band.

The variable valve of the muffler is closed during the silent mode so that all of the exhaust gas passes through the muffler, and the variable valve of the muffler is open during the sport mode so that at least some of the exhaust gas does not pass through the muffler.

In the system and method according to the present invention as stated above, the driver can drive easily and enjoy pleasure of driving by controlling exhaust sound of the vehicle automatically according to the music chosen by the driver.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
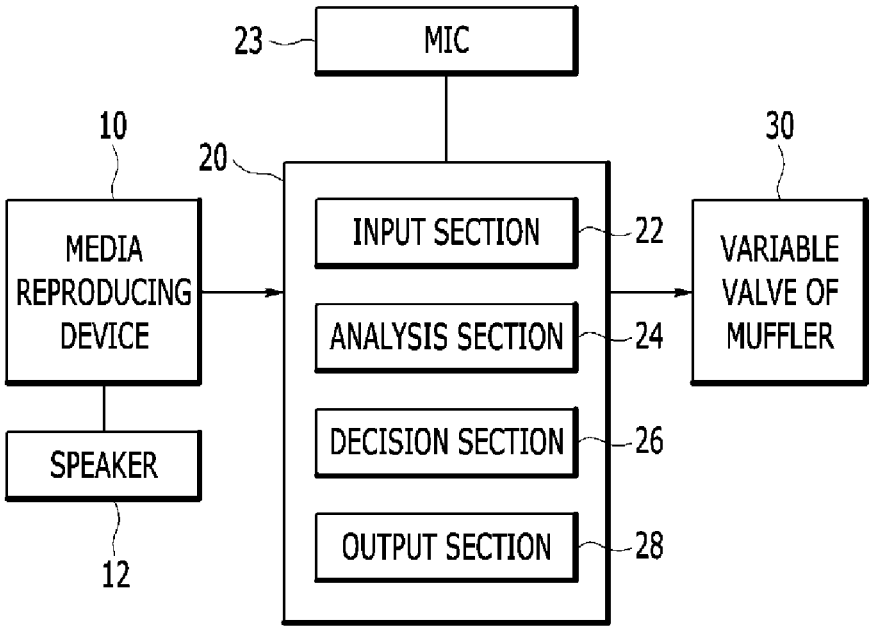
FIG. 1 is a block diagram schematically illustrating an exemplary system for controlling exhaust sound of a vehicle automatically according to the present invention.

FIG. 1 is a block diagram schematically illustrating a system for controlling exhaust sound of a vehicle automatically according to various embodiments of the present invention.

As shown in FIG. 1, the system of controlling exhaust sound of the vehicle automatically according to various embodiments of the present invention may include a media reproducing device 10, a control unit 20, and a variable valve 30 of a muffler.

The media reproducing device 10 that plays music from a media device (e.g., a smartphone, an MP3 player, a CD player, and a tape recorder) containing a music signal may be installed in the vehicle. That is, the music stored in the media device is connected to the media reproducing device 10 for playing or the music signal stored in the media reproducing device 10 is played directly. The media reproducing device 10 may include a speaker 12 for outputting a music playback signal. The meaning of the media reproducing device 10 playing the music in this specification and scope of the appended claims should be understood as the media reproducing device 10 outputting a music playback signal input from another music playback device for playing the music as well as the media reproducing device 10 playing an audio file directly.

The control unit 20 receives the music playback signal output from the media reproducing device 10, analyzes a frequency of the music playback signal, and generates a drive signal by determining a mode of the music. To this end, the control unit 20 may be realized by one or more processors activated by a predetermined program, and the predetermined program may be programmed to perform each step of a method of controlling exhaust sound of the vehicle automatically according to various embodiments of the present invention. The control unit 20 includes an input section 22, an analysis section 24, a determination section 26, and an output section 28.

The input section 22 receives the music playback signal output from the media reproducing device 10 through a microphone 23 mounted in the vehicle. Otherwise, the input section 22 receives the music signal directly from the media reproducing device 10.

The analysis section 24 analyzes the frequency of the music playback signal or the music signal input from input section 22. The analysis section 24 may basically use Fourier transform for analyzing the frequency of the music playback signal. The analysis section 24 may produce a frequency histogram by analyzing the frequency of the music playback signal, and classify the frequency histogram into three frequency bands by analyzing the frequency histogram. That is, the analysis section 24 classifies a result of the frequency histogram into a low frequency band of under 100 Hz, a medium frequency band in a range from 100 Hz to 10,000 Hz, and a high frequency band of over 10,000 Hz by considering that a frequency of a human voice ranges from 100 Hz to 10,000 Hz. Furthermore, the analysis section 24 forms the result of the frequency histogram into an array of each frequency band.

The determination section 26 compares a level of each frequency band's average by using the analyzed result of the frequency histogram, and then determines whether a mode of the music is a sport mode or a silent mode. Hereinafter, a method of determining the sport mode or the silent mode at the determination section 26 will be described in detail.

Figure 2:
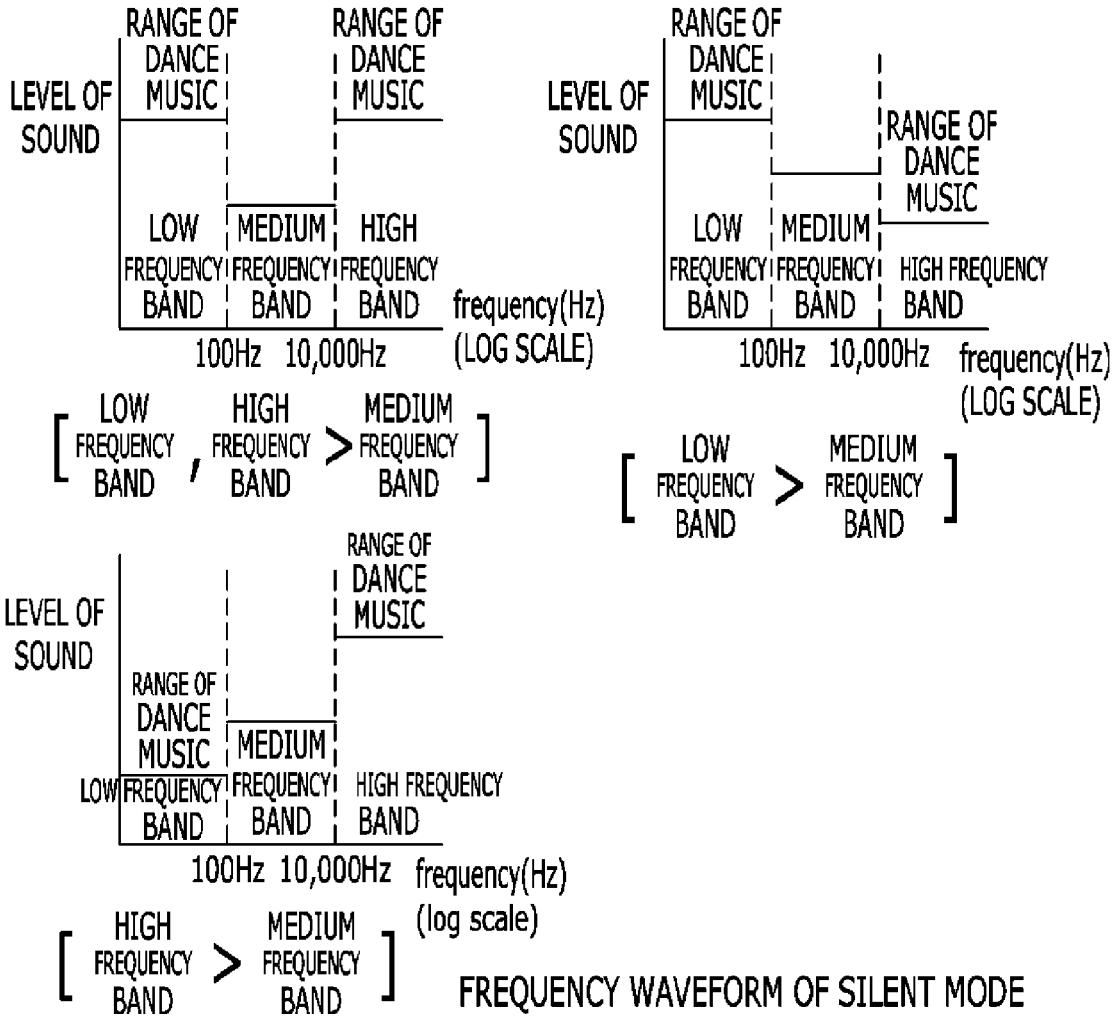
FIG. 2 is a schematic graph showing examples of a frequency band of each mode for determining the mode according to the present invention.
Figure 2:
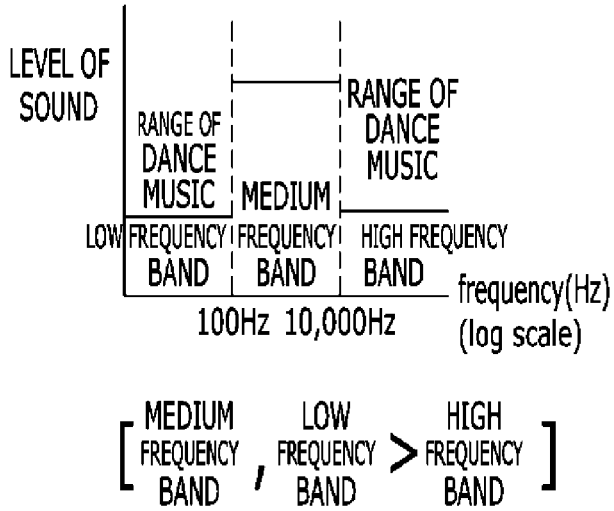
Figure 3:
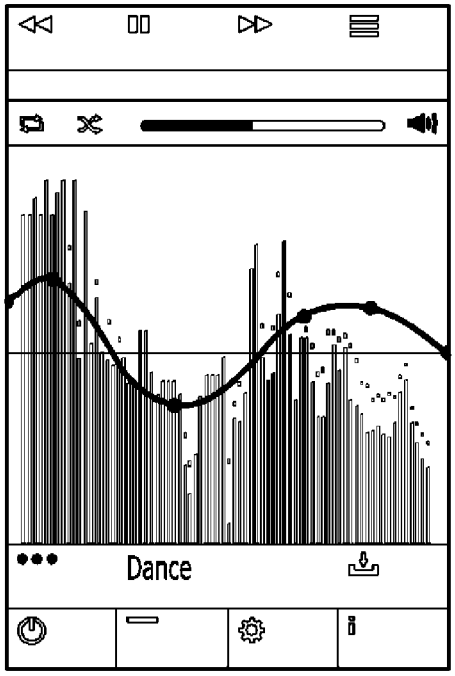
FIG. 3 is a diagram showing examples of a frequency waveform of each mode's music according to the present invention.
Figure 3:
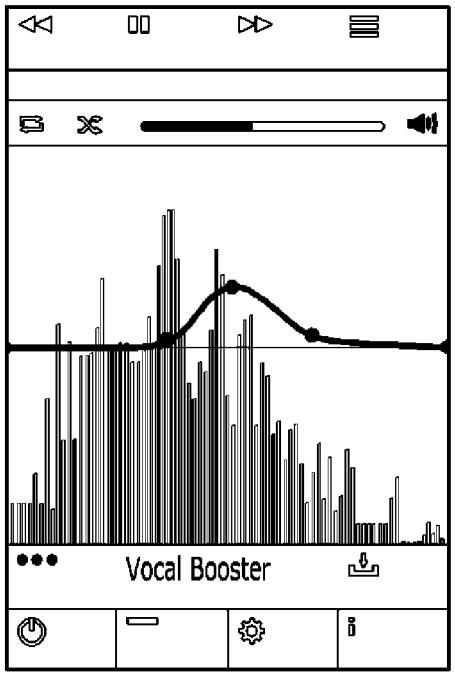

FIG. 2 is a schematic graph showing examples of a frequency band of each mode for determining the mode according to various embodiments of the present invention, and FIG. 3 is a diagram showing examples of a frequency waveform of each mode's music according to various embodiments of the present invention.

As shown in FIG. 2, considering that a register of the low frequency band is a low-pitched tone and a register of the high frequency band is a high-pitched tone, the determination section 26 determines a silent mode when a level of the medium frequency band is higher than a level of the low frequency band and a level of the high frequency band. On the other hand, the determination section 26 determines the sport mode when the level of the medium frequency band is lower than or equal to the level of the low frequency band and the level of the high frequency band.

For example, as shown in FIG. 3, the determination section 26 determines the sport mode or silent mode according to the frequency of the music played from the media reproducing device 10. Referring to FIG. 3 (*a*), the level of the medium frequency band is lower than the level of the low frequency band and the level of the high frequency band. Therefore, the determination section 26 determines the music signal that has the frequency histogram of FIG. 3 (*a*) by the sport mode. Generally fast and funky music such as dance music or rock music may be determined as the sport mode.

On the other hand, referring to FIG. 3 (*b*), the level of the medium frequency band is higher than the level of the low frequency band and the level of the high frequency band. Therefore, the determination section 26 determines the music signal that has the frequency histogram of FIG. 3 (*b*) by the silent mode. Generally relaxing and unobtrusive music such as classical music or ballad music may be determined as the silent mode.

After the determination section 26 determines the sport mode or the silent mode depending on the music playback signal, the output section 28 generates a drive signal according to the mode of the music. The output section 28 outputs the generated drive signal to the variable valve 30 of the muffler and controls the variable valve 30 of the muffler.

The variable valve 30 of the muffler determines whether to be open or closed by receiving the drive signal output from the output section 28.

Figure 4:
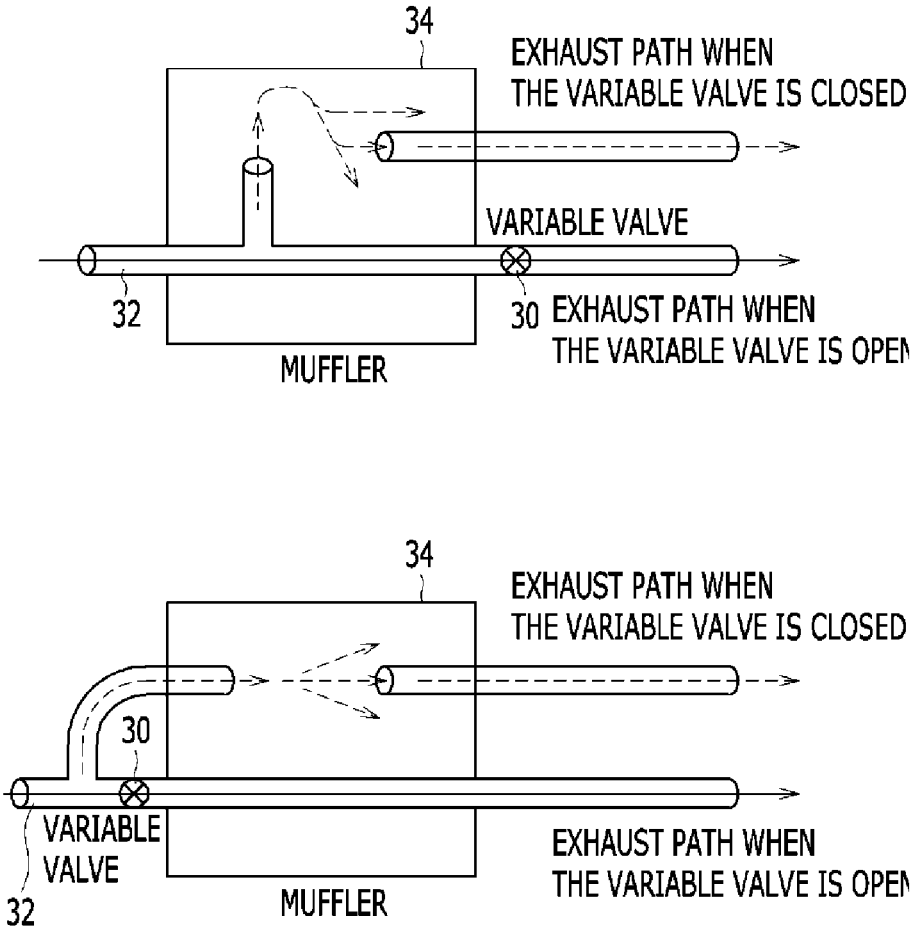
FIG. 4 is a diagram explaining an operation principle of an exemplary variable valve of a muffler according to the present invention.

FIG. 4 is a diagram explaining an operation principle of the variable valve of the muffler according to various embodiments of the present invention.

As shown in FIG. 4, the variable valve 30 of the muffler may be disposed at an entrance or an exit of an exhaust pipe 32 passed through a muffler 34, and adjusts the exhaust sound of the exhaust gas emitted through the exhaust pipe 32. The variable valve 30 of the muffler may be configured to increase the exhaust sound by being open during the sport mode so that the exhaust gas is emitted through the exhaust pipe 32 and at least some of the exhaust gas does not pass through the muffler 34. On the other hand, the variable valve 30 of the muffler may be configured to decrease the exhaust sound by being closed during the silent mode so that all of the exhaust gas passes through the muffler 34. That is, the exhaust sound may be controlled by appropriately opening or closing the variable valve 30 of the muffler.

The variable valve 30 of the muffler may be one of common and various valves, and may be driven by a common solenoid.

Hereinafter, referring to FIG. 5, a method of controlling exhaust sound of the vehicle automatically according to various embodiments of the present invention will be described in detail.

Figure 5:
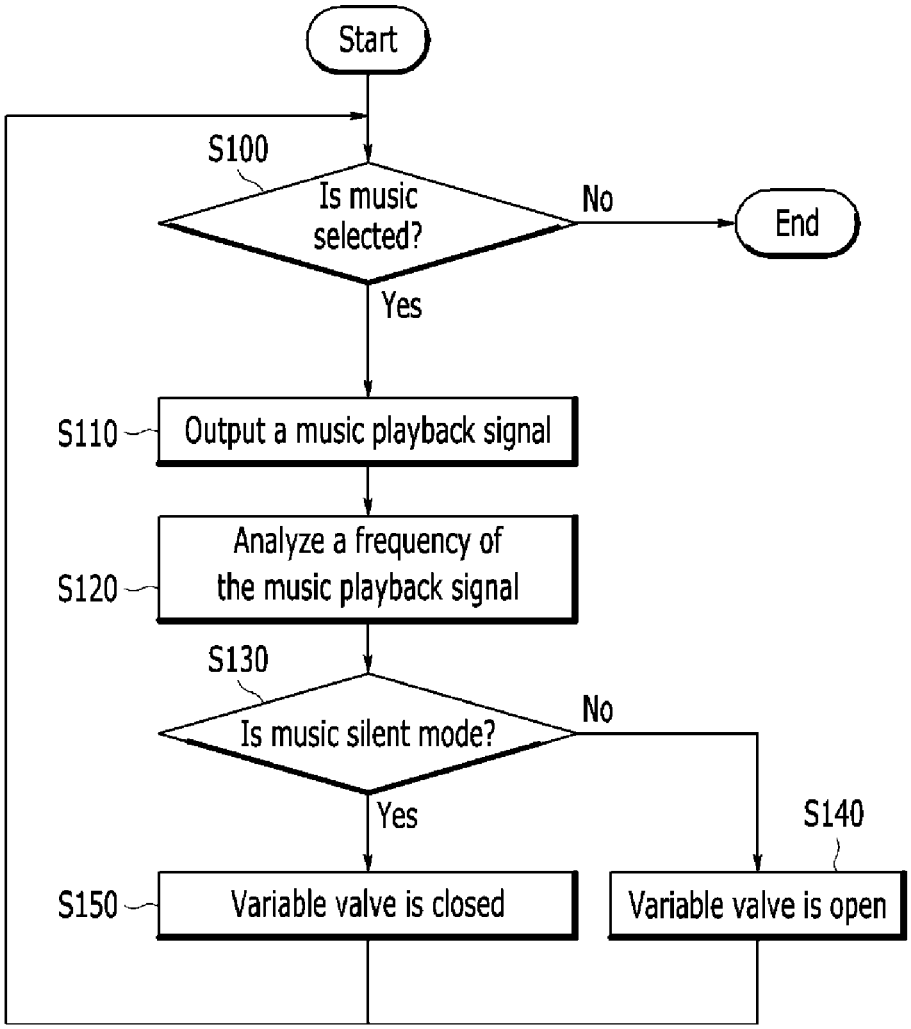
FIG. 5 is a flowchart explaining an exemplary method of controlling exhaust sound of a vehicle automatically according to the present invention.

FIG. 5 is a flowchart explaining a method of controlling exhaust sound of the vehicle automatically according to various embodiments of the present invention.

As shown in FIG. 5, a method of controlling exhaust sound of the vehicle automatically according to various embodiments of the present invention starts with determining whether music is selected at step S100. If the music is selected, the process proceeds to step S110, otherwise the method of controlling the exhaust sound of the vehicle automatically according to various embodiments of the present invention is finished.

If the music is selected in step S100, a music playback signal is output from the media reproducing device 10 at step S110. For example, when the music stored in the media reproducing device 10 or stored in another media device connected to the media reproducing device 10 is played, the music playback signal is output from the media reproducing device 10 through the speaker 12. The meaning that the music is played in this specification and scope of the appended claims should be understood as the music signal stored in another media device connected to the media reproducing device 10 being played as well as the music signal stored in the media reproducing device 10 being played.

If the music playback signal is output from the media reproducing device 10, the control unit 20 analyzes the frequency of the music playback signal at step S120. The input section 22 receives the music playback signal through the microphone 23 or from the media reproducing device 10 directly in order to analyze the frequency of the music playback signal, and the analysis section 24 produces the frequency histogram by transforming the music playback signal by using Fourier transform.

As described above, the analysis section 24 classifies the frequency histogram into the low frequency band, the medium frequency band, and the high frequency band.

If the frequency of the music playback signal is classified into three frequency bands according to the analyzed result of the frequency histogram in step S120, the determination section 26 determines whether the music playback signal is the music of the sport mode or the silent mode at step S130. The determination section 26 determines the silent mode when the level of the medium frequency band is higher than the level of the low frequency band and the level of the high frequency band, and determines the sport mode when the level of the medium frequency band is lower than or equal to the level of the low frequency band or the level of the high frequency band.

If the music playback signal is determined to be the sport mode or the silent mode in step S130, the output section 28 generates the drive signal according to the mode of the music. The output section 28 outputs the generated drive signal to the variable valve 30 of the muffler and controls the variable valve 30 of the muffler.

If the music playback signal is not determined as silent mode in step S130, the music playback signal is determined as sport mode, and then the output section 28 outputs the drive signal for opening the variable valve 30 at step S140. That is, exhaust gas does not pass through enough of the muffler 34 and is emitted to outside of the vehicle by opening the variable valve 30 of the muffler so that the exhaust sound is increased.

Contrary to this, if the music playback signal is determined as the silent mode in step S130, the output section 28 outputs the drive signal for closing the variable valve 30 of the muffler at step S150. That is, exhaust gas passes through the muffler 34 and is muted by closing the variable valve 30 of the muffler so that the exhaust sound is decreased.

After performing step S140 or S150, the control unit 20 proceeds to step S100 and repeatedly performs each step of the method of controlling the exhaust sound of the vehicle automatically according to various embodiments of the present invention.

Meanwhile, the method of controlling the exhaust sound of the vehicle automatically is performed while the engine of the vehicle operates, and on the contrary, is not performed while the engine of the vehicle is turned off.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A system of controlling exhaust sound of a vehicle automatically, comprising:

a media reproducing device which plays music and outputs a music playback signal;

a control unit which analyzes a frequency of the music playback signal output from the media reproducing device and generates a drive signal according to the frequency; and a variable valve of a muffler installed in the muffler which adjusts the exhaust sound according to the drive signal output from the control unit, wherein the control unit comprises:

an input section which receives the music playback signal;

an analysis section which analyzes the frequency of the music playback signal;

a determination section which determines a mode of the music played currently according to the analyzed frequency of the music playback signal; and an output section which generates and outputs a drive signal according to a determined mode of the music, and wherein the analysis section produces a frequency histogram by transforming the frequency of the music playback signal, and wherein the analysis section classifies the frequency of the music playback signal into a low frequency band, a medium frequency band, and a high frequency band, and wherein the determination section determines a silent mode when a level of the medium frequency band is higher than a level of the low frequency band and a level of the high frequency band, and the determination section determines a sport mode when the level of the medium frequency band is lower than or equal to the level of the low frequency band or the level of the high frequency band.

2. The system of claim 1, wherein the variable valve of the muffler is open during the sport mode so that at least some of exhaust gas does not pass through the muffler, and the variable valve of the muffler is closed during the silent mode so that all of the exhaust gas passes through the muffler.

3. A method of controlling exhaust sound of a vehicle automatically by a variable valve of a muffler installed in the muffler, comprising:

determining, by a control unit, whether music is selected;

outputting, by a media reproducing device, a music playback signal if the music is selected;

analyzing, by the control unit, a frequency of the music playback signal;

determining, by the control unit, a mode of the music according to the analyzed frequency; and driving, by the control unit, the variable valve of the muffler according to the determined mode, wherein analyzing the frequency of the music playback signal comprises:

receiving the music playback signal;

producing a frequency histogram by transforming the music playback signal; and classifying the music playback signal analyzed by frequency into a low frequency band, a medium frequency band, and a high frequency band, and wherein determining of the mode of the music according to the analyzed frequency comprises:

determining, by the control unit, whether a level of the medium frequency band is higher than a level of the low frequency band and a level of the high frequency band;

determining, by the control unit, a silent mode when the level of the medium frequency band is higher than the level of the low frequency band and the level of the high frequency band; and determining, by the control unit, a sport mode when the level of the medium frequency band is lower than or equal to the level of the low frequency band or the level of the high frequency band.

4. The method of claim 3, wherein the variable valve of the muffler is closed during the silent mode so that all of the exhaust gas passes through the muffler.

5. The method of claim 3, wherein the variable valve of the muffler is open during the sport mode so that at least some of the exhaust gas does not pass through the muffler.

* * * * *